US006135934A

United States Patent [19]

Couch

[11] Patent Number: 6,135,934

[45] Date of Patent: Oct. 24, 2000

[54] LAP ROLLER FOR MECHANICALLY FASTENED SYSTEMS

[76] Inventor: Victor Couch, 2864 Pollak Ave. NE., Palm Bay, Fla. 32905

[21] Appl. No.: 09/368,667

[22] Filed: Aug. 5, 1999

[51] Int. Cl.[7] ..... B05C 1/08

[52] U.S. Cl. ..... 492/13; 492/19; 15/230.11

[58] Field of Search ..... 15/230.11; 492/13, 492/16, 17, 19

[56] References Cited

U.S. PATENT DOCUMENTS

| | | | |
|---|---|---|---|
| 2,321,511 | 6/1943 | Piercy | 15/230.11 |
| 3,008,167 | 11/1961 | Pharris et al. | 15/230.11 |
| 3,082,459 | 3/1963 | Johnson | 15/230.11 |
| 3,532,032 | 10/1970 | Weber | 94/39 |
| 4,548,016 | 10/1985 | Dubich et al. | 52/749.12 |
| 5,242,362 | 9/1993 | Talamantez | 492/13 |
| 5,970,568 | 10/1999 | Mulcahy, Sr. | 15/230.11 |

*Primary Examiner*—David P. Bryant
*Assistant Examiner*—Marc W. Butler
*Attorney, Agent, or Firm*—Robert M. Downey, P.A.

[57] ABSTRACT

A lap roller apparatus that enables a single individual to simultaneously seal the system and roll the lap of a protective membrane includes an elongated handle with one distal end having a plurality of rollers rotatably supported on a transverse axle, wherein at least one of the rollers is able to rise and drop, perpendicular to the axis of rotation, to a greater extent than the other rollers as the rollers travel along the lap.

14 Claims, 2 Drawing Sheets

LAP ROLLER FOR MECHANICALLY FASTENED SYSTEMS

BACKGROUND OF THE INVENTION

1. Field of the Invention

The present invention relates to mechanical fastening systems and more particularly, to an apparatus or tools for securing a flexible membrane to a roofing substrate with a protective overlap.

2. Discussion of the Relevant Art

The prior art discloses many methods for covering flat roofs wherein the roofing material is an adhered membrane. The inexpensive systems utilize a mechanical fastening technique that affix the membrane to the roof substrate by metal fasteners or rubberized nailing strips. Additional sealing strips or caps are then required to keep the puncture membrane water tight. Generally, this type of installation is cumbersome, as well as time consuming and violates the integrity of the membrane.

Typical of prior art construction techniques is disclosed in U.S. Pat. No. 3,532,032 issued to Weber. Another apparatus is disclosed in U.S. Pat. No. 4,548,016 issued to Dubich, et al. which utilizes a complicated roller assembly and a channel member into which the protective membrane is inserted.

However, there is no showing or suggestion of an apparatus that is operable by one person that can simultaneously seal the system and roll a lap joint for perfect sealing of the membrane.

SUMMARY OF THE INVENTION

Therefore, it is an object of the present invention to overcome the shortcomings of the prior art and provide a relatively simple and inexpensive tool that permits one person to simultaneously seal the system and roll the lap joint for perfect sealing of the membrane.

It is another object of the present invention to provide an apparatus that has relatively few moving parts.

It is yet another object of the present invention to provide an apparatus that has a relatively long useful life before requiring maintenance.

The foregoing and other objects and advantages will appear from the description to follow. In the description, reference is made to the accompanying drawing, which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the spirit and scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described by way of example, with reference to the accompanying drawings in which.

DESCRIPTION OF THE PREFERRED EMBODIMENT

Figure 1:
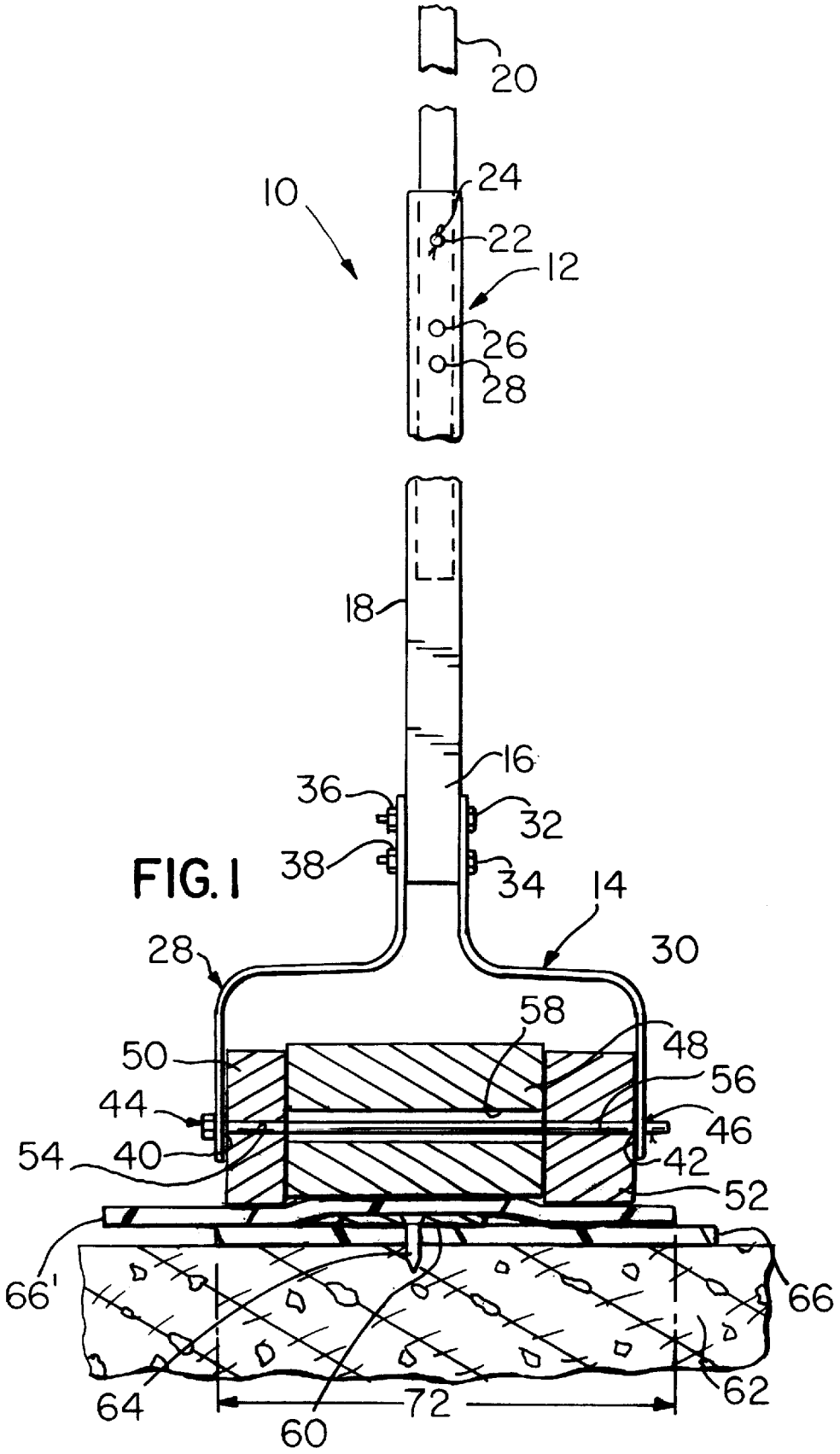
FIG. 1 is a front view in elevation, partially in cross-section, of a lap roller apparatus, according to the principles of the present invention.
Figure 2:
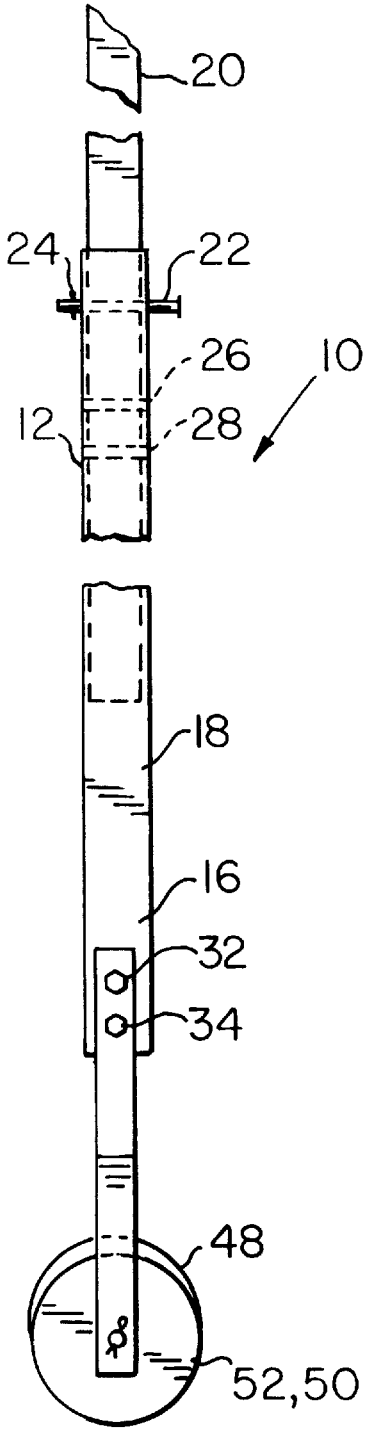
FIG. 2 is a side view in elevation, of the lap roller shown in FIG. 1.
Figure 3:
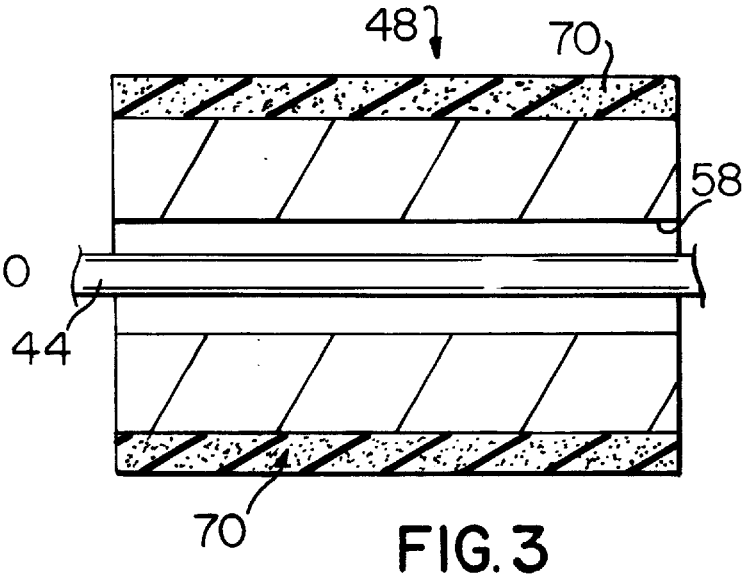
FIG. 3 is a cross-sectional view in elevation of the center roller.

Referring to the figures and in particular to FIG. 1, there is shown a lap roller apparatus 10, according to the principles of the present invention, which includes an adjustable handle member 12 and a roller mounting assembly 14, that is affixed on one distal end 16 of the handle member 12.

Handle member 12 is fabricated in two sections 18 and 20 so that section 20 may be received into hollow section 18 (telescopes) and held in place by a pin 22 and a retainer clip 24 inserted in a plurality of through apertures 26 and 28 provided in the handle member sections 18 and 20.

Roller mounting assembly 14 has two bracket members 28 and 30, one end of which, are mounted diametrically opposed on the handle section 18, in a conventional manner, by bolts 32 and 34 and nuts 36 and 38, respectively. The other ends of bracket members 28 and 30 are provided with apertures 40 and 42, respectively, adapted to receive an axle bolt 44 therein that is retained in place by retainer clip 46, in a conventional manner.

Rotatably mounted on the axle bolt 44 is a center roller 48, a first end roller 50 and a second end roller 52. Each of which are provided with apertures 54, 56 and 58. The aperture 56 that is provided on the center roller 48 is larger in diameter than the diameter of the axle bolt 44 so that the center roller 48 may rise up over caps or plates 60 that are fastened to the roof 62 by nails 66 and a layer of overlapping membrane 66.

Apertures 54 and 56 have the same diameter and freely rotate on axle bolt 44. Preferably all the rollers 48, 50 and 52 are sufficiently weighted to apply pressure to the overlapping membrane 72, with the first end roller 50 being of a different length than the second end roller 52, both of which are shorter in length than the center roller 48. The center roller 48, being the longest roller, is shown in its raised position by the broken line 68 in FIG. 1. The center roller 48 may also be provided with a thick coating of resilient material 70, if desired, to provide additional pressure to seal around the caps or plates 60.

The rollers 48, 50 and 52 are readily changeable to work on different size caps and plates 60 (2 or 3 inches round or square) or be changed in size to work on heat welding machines, not shown, for single ply roofing membranes 66.

Preferably, the rollers 48, 50 and 52 are fabricated from cold rolled steel having a diameter of 2½ inches. The first end roller 50 is 1½ inches long, the second end roller 52 is 1 inch long, and the center roller is 3½ inches long. The first and second end rollers 50 and 52 are provided with a centrally disposed aperture of ¼ of an inch in diameter and the center roller 48 is provided with a centrally disposed aperture of ¾ of an inch in diameter. The diameter of the axle bolt 44 is ¼ of an inch and is retained in position, in a conventional manner by retainer clip 46.

In operation, the adjustable handle member 12 is set to the desired length by the individual performing the work, somewhere between 5 and 10 feet. The first layer of membrane 66 is fastened to the roof 62, in a conventional manner, with the caps or plates 60 being nailed to the roof 62 with predetermined spacing. A roll of lapping membrane 66' overlays the first layer membrane 66 and the plates 60 a predetermined length and is then rolled out. Heat is applied to the overlap portion 72 while the lap roller apparatus is rolled over the overlap portion 72 by the same individual providing heat the overlap 72. Thereby providing a perfect seal to the overlap 72, since the center roller 48 rises over the plates 60 while the end rollers 50 and 52 seal along the overlap 72.

While the rollers are of a sufficient weight to apply downward sealing pressure to the overlapping membrane 72, it is important that the rollers are not overly weighted to the extent that they cause too much of the sealing substance (e.g., SBS material) to be pushed out from between the overlapping membrane 72. In a preferred embodiment, the entire apparatus 10 weighs approximately 11 pounds.

Hereinbefore has been disclosed a simplified lap roller apparatus that may be utilized by the same individual that is supplying heat to the lap joint and has a minimum number of parts.

It will be understood that various changes in the detail, materials, arrangements of parts and operating conditions which have been herein described and illustrated in order to explain the nature of the invention may be made by those skilled in the art within the principles and scope of the instant invention.

What is claimed is:

1. A lap roller apparatus suitable for an individual to simultaneously seal and roll an overlap of a membrane system, comprising:

an elongated handle means having one distal end with a mounting means disposed thereon suitable for mounting a plurality of rollers;

said mounting means having an axle disposed transverse to said elongated handle means;

a plurality of weighted rollers, each of said rollers having a centrally disposed aperture sized for receipt of said axle therethrough so that said plurality of rollers are adapted to freely rotate on said axle, thereby defining an axis of rotation and each of said rollers further including an outer cylindrical surface structured for engaging and applying downward pressure on the membrane system;

said centrally disposed aperture of at least one of said plurality of rollers being greater in diameter than the centrally disposed apertures of a remainder of said plurality of rollers, wherein said at least one of said plurality of rollers is able to rise and drop, in perpendicular relation to said axis of rotation, as said plurality of rollers travel along the membrane system.

2. A lap roller apparatus according to claim 1 wherein said elongated handle means is adjustable in length.

3. A lap roller apparatus according to claim 1 wherein said plurality of rollers include a central roller and two side rollers.

4. A lap roller apparatus according to claim 1 wherein said plurality of rollers are each of a different length.

5. A lap roller apparatus according to claim 1 wherein said plurality of rollers includes a central roller that is covered with a resilient material.

6. A lap roller apparatus suitable for an individual to simultaneously seal and roll an overlap of a membrane system comprising:

a handle means, adjustable in length, having one distal end with a mounting means disposed thereon suitable for mounting a plurality of rollers;

said mounting means having an axle disposed transverse to said elongate handle means;

a plurality of weighted rollers, each of said rollers having:

a centrally disposed aperture adapted to freely rotate on said axle, thereby defining an axis of rotation;

an outer cylindrical surface structured for engaging and applying downward pressure on the membrane system; and a different length; and one of said plurality of rollers being provided with a centrally disposed aperture greater in diameter than the diameter of said axle to enable said one of said plurality of rollers to rise and fall relative to a remainder of said plurality of rollers and in perpendicular relation to said axis of rotation, as said plurality of rollers travel along the membrane system.

7. A lap roller apparatus according to claim 6 wherein said plurality of rollers include a central roller and two side rollers.

8. A lap roller apparatus according to claim 7 wherein said central roller is provided with a centrally disposed aperture greater in diameter than the diameter of said axle.

9. A lap roller apparatus according to claim 8 wherein said central roller is covered with a resilient material.

10. A lap roller apparatus according to claim 8 wherein said central roller is longer in length than either side roller.

11. A lap roller apparatus suitable for an individual to simultaneously seal and roll an overlap of a membrane system, comprising:

an elongated handle means having one distal end with a mounting means disposed thereon suitable for mounting a plurality of rollers;

said mounting means having an axle disposed transverse to said elongated handle means;

a plurality of weighted rollers including a center roller and first and second end rollers positioned and disposed on opposite sides of said center roller, each of said rollers having a centrally disposed aperture sized for receipt of said axle therethrough so that said plurality of rollers are adapted to freely rotate on said axle, thereby defining an axis of rotation and each of said rollers further including an outer cylindrical surface structured for engaging and applying downward pressure on the membrane system;

said centrally disposed aperture of said center roller being greater in diameter than the centrally disposed apertures of said first and second end rollers, wherein said center roller is able to rise and drop relative to said first and second end rollers, in perpendicular relation to said axis of rotation, as said plurality of rollers travel along the membrane system and said center roller travels over raised areas on the overlap of the membrane system.

12. A lap roller apparatus according to claim 11 wherein said elongated handle means is adjustable in length.

13. A lap roller apparatus according to claim 11 wherein said plurality of rollers are each of a different length.

14. A lap roller apparatus according to claim 11 wherein said center roller is covered with a resilient material.

* * * * *